US005358794A

United States Patent [19]

Kawamoto et al.

[11] Patent Number: 5,358,794

[45] Date of Patent: Oct. 25, 1994

[54] STEEL STRIP AND METHOD FOR PRODUCING ROLLING DULL ROLL

[75] Inventors: Takaharu Kawamoto; Yasutaka Nawata; Yasuo Hamamoto; Hiromi Toyota; Shuichi Shiozawa, all of Kimitsu, Japan

[73] Assignee: Nippon Steel Corporation, Tokyo, Japan

[21] Appl. No.: 50,140

[22] PCT Filed: Aug. 26, 1992

[86] PCT No.: PCT/JP92/01079

§ 371 Date: May 3, 1993

§ 102(e) Date: May 3, 1993

[87] PCT Pub. No.: WO93/04796

PCT Pub. Date: Mar. 18, 1993

[30] Foreign Application Priority Data

| | | | |
|---|---|---|---|
| Sep. 3, 1991 | [JP] | Japan | 3-248502 |
| Sep. 3, 1991 | [JP] | Japan | 3-248503 |
| Sep. 3, 1991 | [JP] | Japan | 3-248504 |
| Sep. 13, 1991 | [JP] | Japan | 3-261430 |
| Sep. 13, 1991 | [JP] | Japan | 3-261431 |

[51] Int. Cl.[5] ..... B21B 27/00; B21D 53/00

[52] U.S. Cl. ..... 428/600; 428/687; 29/895.32

[58] Field of Search ..... 428/687, 600, 666, 667, 428/614; 29/895.32; 492/30, 54, 34, 35, 36, 37; 205/122, 135

[56] References Cited

U.S. PATENT DOCUMENTS

| | | | |
|---|---|---|---|
| 3,775,261 | 11/1973 | Rieth et al. | 205/122 |
| 4,322,600 | 3/1982 | Crahay | 219/121 LK |
| 4,329,562 | 5/1982 | Crahay et al. | 219/121 LJ |
| 4,462,600 | 7/1984 | Crahay | 350/274 |
| 4,783,378 | 11/1988 | Wakui et al. | 428/687 |
| 4,795,681 | 1/1989 | Furukawa et al. | 428/687 |
| 4,798,772 | 1/1989 | Furukawa | 428/687 |
| 4,806,731 | 2/1989 | Bragard et al. | 428/687 |
| 4,978,583 | 12/1990 | Wakui et al. | 428/687 |

FOREIGN PATENT DOCUMENTS

| | | | |
|---|---|---|---|
| 51-41072 | 10/1976 | Japan . | |
| 54-61043 | 5/1979 | Japan . | |
| 62-168602 | 7/1987 | Japan . | |
| 2-175882 | 7/1990 | Japan . | |
| 3-71905 | 3/1991 | Japan . | |
| 3-161103 | 7/1991 | Japan . | |
| WO93/0476 | 3/1993 | PCT Int'l Appl. . | |
| 2069906A | 9/1981 | United Kingdom | 428/687 |

*Primary Examiner*—John Zimmerman
*Attorney, Agent, or Firm*—Kenyon & Kenyon

[57] ABSTRACT

In order to improve the sharpness, after painting, of a steel strip and, at the same time, improve the press moldability of the steel strip, the steel strip of the present invention is characterized by having a plurality of small recessed portions transferred by means of a rolling dull roll having a protrusion composed mainly of Cr and homogeneously provided on the surface of the roll; the recessed portion having a configuration satisfying requirements of a diameter, d, of 50 to 500 μm, a depth, h, of the recessed portion of 2 to 40 μm and a total volume of recessed portions per $mm^2$ of the surface of the steel strip of $0.10\times10^6$ $\mu m^3$ or more, the center line distance, $P_1$, between recessed portions adjacent to each other in the direction of rolling being in the range of from 1.0 d to 4.0 d, the center line distance, $P_2$, between rows in the direction of rolling being in the range of from 1.0 d to 4.0 d.

7 Claims, 9 Drawing Sheets

Fig.

STEEL STRIP AND METHOD FOR PRODUCING ROLLING DULL ROLL

DESCRIPTION

1. Technical Field

The present invention relates to a steel strip having excellent painting sharpness and press moldability and a rolling dull roll for use in the production of said steel strip.

2. Background Art

The surface of a cold-rolled steel strip to be worked is generally subjected to dull finishing for the purpose of facilitating press molding, because a working lubricant is reserved during press working in an uneven portion formed on the surface of a steel strip, which serves to reduce the friction between the mold and the steel strip and, at the same time, prevent the occurrence of seizure.

Press moldability has been studied from the viewpoint of an iron strip as material and molding technique. However, with an increase in the precision and complexity of products, there is an ever-increasing demand for more sophisticated and diversified steel strip properties.

On the other hand, armored steel strips for the bodies of automobiles, domestic appliances, etc. are subjected to paint finishing for the purpose of imparting an aesthetic sense to the steel strips. In this case, it is required that no deterioration in the aesthetic sense due to irregular reflection occur, that is, the so-called "painting sharpness" should be excellent.

Examples of the above-described prior art include one disclosed in Japanese Unexamined Patent Publication (Kokai) No. 62-168602 entitled "Steel Strips for Painting and Method for Producing the Same". In the steel strip proposed in this document, the center line average roughness, Ra, on the surface thereof is in the range of from 0.3 to 2.0 μm, and the microscopic morphology constituting the surface roughness comprises a trapezoidal crest portion having a flat crest face and a grooved root portion formed so as to surround the whole or part of the periphery of the crest portion and an intermediate flat portion formed in such a manner that it is located between the crest portions and outside the root portions and has a height higher than the bottom of the root portion and lower than or equal to the crest of the crest portion; said configuration satisfying a requirement represented by the following formulae: $0.85 \leqq Sm \leqq 1.7$, $Sm - D < 280$ (μm), $30 \leqq d_0 \leqq 500$ (μm) and $20 \leqq \eta \leqq 85$ (%) wherein Sm represents the average center line distance between adjacent crest portions, D represents the average diameter of the outer periphery of the root portion, $d_0$ represents the average diameter of the flat crest face of the crest portion and $\eta$ (%) represents the proportion of the sum of the area of the flat crest face and the area of the flat face of the intermediate flat portion to the total area.

Respective profiles of the above-described conventional roll and steel strip surfaces are shown in FIGS. 1 and 2, wherein D: the average outer diameter of a flange 2 of the roll surface = the average diameter of the periphery of a root portion 11 of a steel strip surface;

d: the average diameter of a crater 1 on the roll surface;

$d_o$: the average diameter of a flat crest face 8 of a crest portion 10 of the steel strip surface;

H: the depth of the crater 1 on the roll surface;

$h_1$: the height of the flange 2 on the surface of the roll surface = the depth defined as a distance from an intermediate flat portion 9 on the steel strip surface to the bottom of the root portion 11;

$h_2$: the height defined as a distance from the intermediate flat portion 9 to the flat crest face 8 of the crest portion 10 on the steel strip surface.

Sm: the average center distance between adjacent craters 1 on the roll surface = the average center distance between adjacent crest portion 10 on the surface of the steel strip surface;

$\alpha$: the width of the flange 2 on the surface of the roll surface; and $\eta$: the area of the flat portion (the sum of the proportion of area, $\eta_1$, of the flat crest face 8 of the crest portion 10 and the proportion of area, $\eta_2$, of the intermediate flat portion 9).

The present status with respect to press moldability is that, in temper rolling conducted for the purpose of finally regulating the roughness of a steel strip, the roughness is transferred to the surface of a steel strip by using a work roll subjected to dulling by means of shot blasting, electric discharge, laser beam or the like. Further, in actual press molding, sole use of mechanical properties (r value, E1 value, etc.) of the steel strip adopted in the art is unsatisfactory as evaluation criteria of press moldability, and the surface roughness of the steel strip, the lubricating oil, etc. also have a great influence on press moldability thereof.

FIG. 3 is a diagram explaining a conventional method for producing a roll. As shown in FIG. 3 (*a*), the surface of a roll 1 is coated with a resin 3 having a thickness of about 5 to 50 μm. An alkaline resin, a resin for coat sealing, etc. are preferred because they have an alkali resistance, a chromic acid resistance, an insulating property, etc., and examples thereof include an acrylic resin, a methacrylic resin, a methacrylic ester, a polyolefin resin, an epoxy resin, a vinyl chloride resin and a polyamide resin. These resins are coated on the surface of a roll so as to form a coating having a thickness of 5 to 50 μm. The coating is conducted by homogeneously depositing the resin on the surface of the roll by irrotational roll drawing, electrodeposition coating, rotational roll coating, spraying, curtain coating, powder coating, winding of a filmy resin, etc. and drying the resultant coating.

As shown in FIG. 3 (*b*), the resin coated roll 1 is then subjected to machining by means of a high-density energy, for example, a laser beam 5. Specifically, the surface of the resin 3 coated is irradiated with a laser beam 5 to melt and remove the portion exposed to the laser beam.

As shown in FIG. 3 (*c*), after the laser beam machining, the roll is plated with chromium in a chromium plating solution. Specifically, the roll is electroplated in a chromium plating solution under a current density of 20 to 50 A/dm$^2$ and a making current of 1000 to 2000 A, which is a making current value capable of providing a diameter, D, of 50 to 200 μm in the recessed portion after dissolution and removal of the resin, that is, a making current value depending upon the effective area ratio of the chromium plated portion, etc., thereby enabling a chromium protrusion having a thickness of 1 to 20 μm to be deposited in the diameter of a bore formed by the above-described laser beam machining. In this case, since the resin is an insulating substance, plating is applied in the bore portion alone in a thickness substantially equal to or smaller than the resin thickness under set plating conditions without deposition of chromium on the surface of the resin. FIG. 3 (*c*) shows the state of the surface after chromium plating, and a chromium protrusion 7 having a curved surface formed by electroplating is deposited in the bore 6 defined by the resin 3 and the surface of the roll 1.

The roll provided with the chromium protrusion 7 is then immersed in a solvent or brushed with a solvent to remove the resin on the surface of the roll.

Thus, as shown in FIG. 3 (*d*), a chromium protrusion 7 is exposed to the surface of the roll 1 from which the resin has been removed.

The above-described prior art is advantageous in that the continuous provision of a protrusion composed mainly of Cr on the surface of a rolling roll at a predetermined interval contributes to an improvement in the service life of the roll owing to the configuration regulation of the chromium protrusion, and contributes to an improvement in press moldability owing to the increase in the amount of stored pressing lubricant in a recessed portion formed on the surface of the steel strip rolled by the present roll, etc.

Direct application of Cr plating on the surface of a substrate steel for a roll causes the area of contact of the Cr protrusion with the roll to become very small because the outer diameter of the Cr protrusion portion is as small as 50 to 200 μm. When this roll is used in rolling, the Cr protrusion portion undergoes a locally concentrated load during rolling due to a lack of bond strength at the Cr protrusion portion, which causes the Cr protrusion portion to fall from the surface of the roll, so that sufficient roughness cannot be transferred to the steel strip.

With respect to sharpness, a high finish coating quality of an outer plate for an automobile, for example, can directly contribute to the overall quality of the automobile and to customer appeal, so that it is a very important quality control item. In press molding the outer plate for an automobile, it is also important for the moldability of the steel material to be such that quality defects, such as cracking, do not occur. In general, the larger the proportion of flat portions on the surface of the steel strip, the better the painting sharpness. On the other hand, press moldability generally improves with an increase in the volume of recessed portions on the surface of the steel strip because the increase in the volume of recessed portions increases the amount of press molding lubricant for wetting the recessed portion. The problem of the prior art is that recessed portions in ring form on the surface of the steel strip cannot occupy a sufficient area of flat portions on the surface of the steel strip such that quality defects do not occur in the molding, so that the owners evaluation of the quality is that the painting sharpness is unsatisfactory. For this reason, having a sufficient area of flat portions on the surface of the steel strip while maintaining a sufficient volume of recessed portions (that is, while maintaining press moldability) has been desired in the art.

A further problem of the prior art is that in FIGS. 1 and 2, since flat portions on the surface of the steel strip have different levels due to the presence of a height, $h_1$, defined as a distance between the flat crest face 8 of the crest portion 10 and the intermediate flat portion 9 on the surface of the steel strip, there also exists a level difference on the coating surface, which spoils the gloss and also leads to distortion of a transferred image, so that the painting sharpness deteriorates.

In the prior art, when the recessed portion is assumed to be in the form of a semicircular sectional ring having a diameter defined as the width, $\alpha$, of a flange 2 on the surface of the roll, the volume of one recessed portion is determined according to the following equation:

$$u=(\tfrac{1}{2}\times(\pi\alpha^2/4)\times\pi(D+d_0)/2 \quad (1)$$

As is apparent from Japanese Unexamined Patent Publication (Kokai) No. 62-168602 on page 6, col. 4, line 17, the width, $\alpha$, of the flange 2 on the surface of the roll is determined according to the following equation:

$$\alpha=0.09\times D \quad (2)$$

Since 1 mm is 1000 μm, the number of recessed portions per $mm^2$ can be determined according to the following equation:

$$n=(1000/Sm)\times(1000/Sm) \quad (3)$$

Therefore, the volume of recessed portions per $mm^2$ is determined according to the following equation:

$$\begin{aligned} V &= u\times n \\ &= 4.99\times 10^3\times(D+d_0)/(Sm/D)^2 \end{aligned} \quad (4)$$

Further, since $D=d_0+2a$ (from FIGS. 1 and 2), $d_0=30$ to 500 μm and $\alpha=20$ to 40 μm (from Japanese Unexamined Patent Publication (Kokai) No. 62-168602 on page 8, col. 1, line 19), $$V=(0.499 \text{ to } 5.389)\times 10^6/(Sm/D)^2 \quad (5)$$

Table 1 shows the relationship between Sm/D, the area, $\eta$, of the flat portion and the volume, V, of the recessed portion per $mm^2$. The area, $\eta$, of the flat portion was extracted from Tables 2*a* and Table 2*b* of the above-described Unexamined patent publication, and the volume, v, of the recessed portion per $mm^2$ was determined by substituting an Sm/D value of 0.85 to 1.75 in the above-described equation (5).

TABLE 1

| Sm/D | Percentage area of flat portion, $\eta$ | Volume of recessed protion per $mm^2$, V |
|---|---|---|
| 1.75 | 0.79 to 0.87 | $0.163\times10^6$ to $1.759\times10^6$ |
| 1.50 | 0.72 to 0.82 | $0.221\times10^6$ to $2.395\times10^6$ |
| 1.28 | 0.62 to 0.76 | $0.304\times10^6$ to $3.289\times10^6$ |
| 1.25 | 0.60 to 0.75 | $0.320\times10^6$ to $3.449\times10^6$ |
| 1.20 | 0.56 to 0.72 | $0.347\times10^6$ to $3.743\times10^6$ |
| 1.10 | 0.48 to 0.67 | $0.413\times10^6$ to $4.454\times10^6$ |
| 1.05 | 0.43 to 0.64 | $0.452\times10^6$ to $4.888\times10^6$ |
| 1.00 | 0.37 to 0.60 | $0.499\times10^6$ to $5.389\times10^6$ |
| 0.85 | 0.29 to 0.60 | $0.690\times10^6$ to $7.459\times10^6$ |

In Table 1, the area, $\eta$, of the flat portion is in the range of from 0.29 to 0.87, and the volume, V, of the recessed portion per $mm^2$ is in the range of from 0.163 to $7.459\times10^6$. The relationship between the area, $\eta$, of the flat portion and the volume, V of the recessed portion per $mm^2$ is shown in FIG. 4. In order to improve the painting sharpness of the prior art, it is necessary to improve the area, $\eta$, of the flat portion in an identical volume, V, per $mm^2$.

The present invention has been made with a view to solving the press moldability problem resulting when an improvement in the painting sharpness, which is the paint finishing quality, is intended, and an object of the present invention is to provide an outer plate for an automobile that is superior to that of the prior art.

SUMMARY OF THE INVENTION

In order to attain the above-described object, the present invention provides:

a steel strip having excellent painting sharpness and press moldability, characterized by having a plurality of small recessed portions provided on the surface of the steel strip; said recessed portion having a configuration satisfying the requirements of a diameter, d, of 50 to 500 μm, a depth, h, of the recessed portion of 2 to 40 μm and a total volume of recessed portions per $mm^2$ of the surface of the steel strip of $0.70\times10^6$ $\mu m^3$ or more, the center line distance, $P_1$, between recessed portions adjacent to each other in the direction of rolling being in the range of from 1.0 d to 2.0 d, the center line distance, $P_2$, between rows in the direction of rolling being in the range of from 1.0 d to 2.0 d;

a steel strip having an excellent painting sharpness, characterized by having a plurality of small recessed portions provided on the surface of the steel strip; said recessed portion having a configuration satisfying requirements of a diameter, d, of 50 to 500 μm, a depth, h, of the recessed portion of 2 to 40 μm and a total volume of recessed portions per $mm^2$ of the surface of the steel strip of $0.10\times10^6$ to $8\times10^6$ $\mu m^3$ and an area proportion of flat portions, other than recessed portions, on the surface of the steel strip of 0.6 or more, the center line distance, $P_1$, between recessed portions adjacent to each other in the direction of rolling being in the range of from 1.5 d to 4.0 d, the center line distance, $P_2$, between rows in the direction of rolling being in the range of from 1.5 d to 4.0 d; and a method for producing a rolling dull roll for producing said steel strip, comprising coating a thin Cr coating on the surface of a roll, coating a thin coating of an insulating resin on the Cr coating, continuously forming a predetermined hole through the coating by regulating irradiation conditions of a high-density energy according to the thickness of the coated resin, immersing the worked roll in a chromic acid solution, subjecting the roll to another Cr plating treatment and then removing the coated resin so as to provide a homogeneous protrusion composed mainly of Cr on the surface of the roll.

BEST MODE FOR CARRYING OUT THE INVENTION

The best mode for carrying out the present invention will now be described in detail.

Figure 5A:
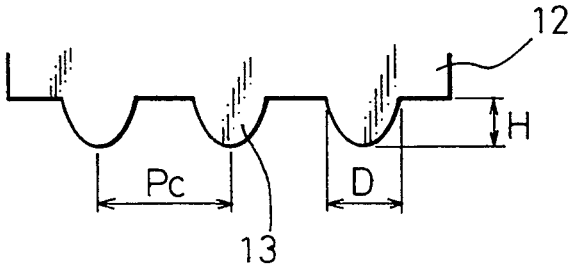
FIGS. 5(*a*) and 5(*b*) are diagrams showing a rolling dull roll (A) for producing the steel strip of the present invention and the steel strip (B) according to the present invention.
Figure 5B:
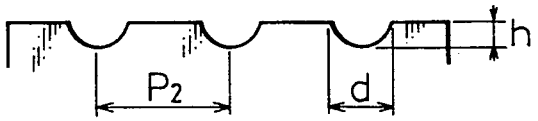

FIG. 5 (A) is a diagram showing the configuration of the cross-section of a roll used in the present invention. The surface of a roll 12 is irradiated with a laser beam to form a hole having a diameter of 50 to 500 μm. Numeral 13 designates a protrusion composed mainly of chromium and deposited and protruded on a recessed portion of the hole in such a manner that the height, H, from the surface of the roll is in the range of from 2 to 40 μm. In this connection, the center line distance, $P_1$, between recessed portions of holes adjacent to each other in the direction of rolling is in the range of from 1.0 D to 4.0 D, and the center line distance, $P_c$, between rows in the direction of rolling is in the range of from 1.0 D to 4.0 D.

When the height, H, of the protrusion 13 exceeds 40 μm, the protrusion 13 often falls from the surface of the roll during rolling or the rolling load causes breakage. For this reason, the smaller the height of the protrusion 13, the better the results, and a height of about 40 μm or less is preferred. However, when the height is smaller than 2 μm, the depth of the recessed portion transferred to the surface of the steel strip is small and the degree of roughness is also small, so that the object of the present invention cannot be attained.

FIG. 5 (B) is a diagram showing the configuration of the cross-section of the steel strip of the present invention that has been subjected to a transferring of a configuration in a percentage transfer of 40 to 100% through temper rolling by means of a roll having the above-described surface configuration. When the percentage transfer is 40% or less, the depth of a recessed portion transferred to the surface of the steel strip is small and, at the same time, the degree of roughness becomes small, so that the object of the present invention cannot be attained.

Figure 6:
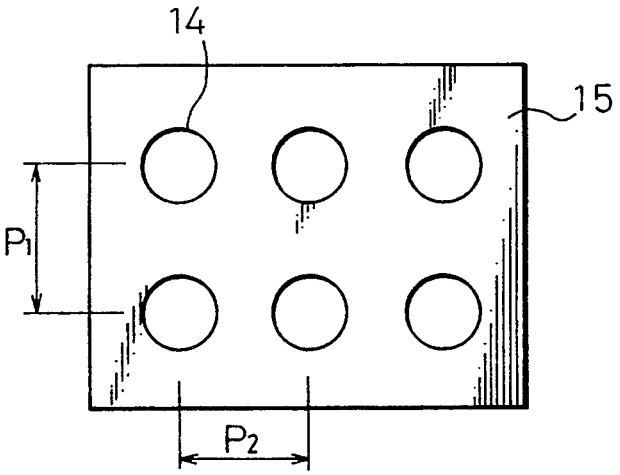
FIG. 6 is a schematic plan view of the steel strip according to the present invention.
Figure 7A:
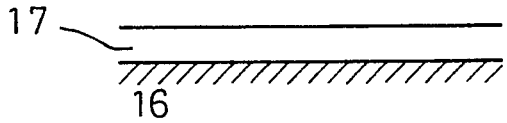
FIGS. 7(*a*), 7(*b*), 7(*c*), 7(*d*) and 7(*e*) are diagrams showing an embodiment of the method for producing a rolling dull roll according to the present invention.
Figure 7B:
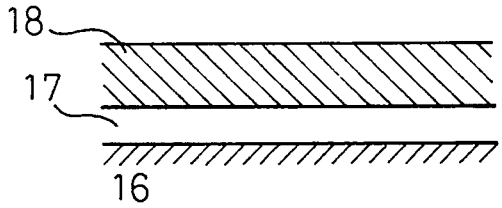
Figure 7C:
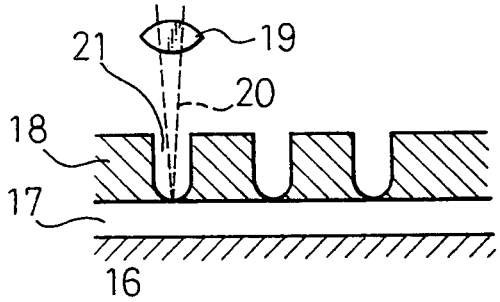
Figure 7D:
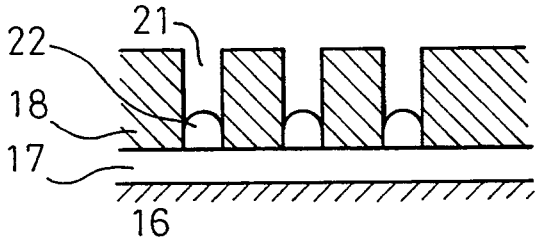
Figure 7E:
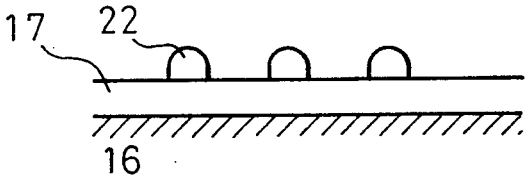

FIG. 6 is a schematic plan view of the surface of the steel strip according to the present invention. A recessed portion having a diameter of 50 to 500 μm is formed on the surface of the steel strip 15. The recessed portions are provided in such a manner that the center line distance, $P_1$, between recessed portions 26 of holes adjacent to each other in the direction of rolling is in the range of from 1.0 d to 4.0 d, and the center line distance, $P_2$, between rows in the direction of rolling is in the range of from 1.0 d to 4.0 , In members, such as outer plates for automobiles, where sharpness and press moldability are required, when this pitch is excessive, the surface roughness of the steel strip becomes low, which creates problems, for example, a lowering in the quality of the steel strip and a lowering in press moldability attributable to the occurrence of slipping, and a deterioration of quality due to a variation in the percentage elongation, etc. On the other hand, when the pitch is unusually small, deterioration occurs in the sharpness after coating due to an increase in the wariness on the surface of the steel strip. For this reason, in the present invention, the pitch was limited to the above-described range. The upper limit depth of the recessed portion of the steel strip is 40 μm taking the above-described height of the protrusion 13 into consideration. When the depth of the recessed portion of the steel strip is smaller than 2 μm, the depth of the recessed portion on the surface of the steel strip and also the degree of roughness becomes small, so that the object of the present invention cannot be attained.

The recessed portion of the steel strip may be trapezoidal and angular when an oil holding effect during pressing, and the effect of lubricating the surface of the steel strip, etc. are taken into consideration, and the configuration of the recessed portion of the steel strip may vary.

The proportion of area, $\eta$, of the flat portion according to the present invention can be determined as follows. At the outset, since 1 mm is 1000 μm, the number of recessed portions, n, per $mm^2$ is determined by the following equation:

$$n=(1000/P_1)\times(1000/P_2) \tag{6}$$

In the area, $\eta$, of the flat portion, since a circular recessed portion having a diameter of d is excluded, when we assume that $P_1=P_2=P$, $$\begin{aligned}\eta &= 1-(\pi d^2 4)\times n/(1000\times 1000)\\ &= 1-(\pi/4)\times(d/P)^2\end{aligned} \tag{7}$$

Since P=1.0 d to 4.0 d, $$\eta=0.215 \text{ to } 0.951 \tag{8}$$

When the volume per recessed portion in the present invention is expressed by the following equation:

$$u=(\pi d^2/4)\times h \tag{9}$$

if we assume that $P_1=P_2=P$, since h=2 to 40 μm, $$\begin{aligned}V &= u\times n\\ &= (\pi/4)\times(d/P)^2\times h\times 10^6\\ &= h\times(1-\eta)\times 10^6\\ &= (2 \text{ to } 40)\times(1-\eta)\times 10^6\ (\mu m^3/mm^2)\end{aligned} \tag{10}$$

The present inventors have conducted tests on P and h based on the above-described equations for each condition.

(1) When P=1.0 d to 1.5 d, $$\eta=0.215 \text{ to } 0.651 \tag{11}$$

When the volume per recessed portion in the present invention is expressed by the following equation:

$$u=(\pi d^2/4)\times h \tag{12}$$

if we assume that $P_1=P_2=P$ and h=2 to 16 μm, $$\begin{aligned}V &= u\times n\\ &= (\pi/4)\times(d/P)^2\times h\times 10^6\\ &= h\times(1-\eta)\times 10^6\\ &= (2 \text{ to } 16)\times(1-\eta)\times 10^6\ (\mu m^3/mm^2)\end{aligned} \tag{13}$$

The relationship between the proportion of area, $\eta$, of the flat portion and the volume, v, of the recessed portion per $mm^2$ was determined according to the above-described equation (13), and the results are given in Table 2.

TABLE 2

| Percentage area of flat portion, $\eta$ | Volume of recessed portion per $mm^2$, V |
|---|---|
| 0.215 | $1.57\times10^6$ to $12.56\times10^6$ |
| 0.250 | $1.50\times10^6$ to $12.00\times10^6$ |
| 0.300 | $1.40\times10^6$ to $11.20\times10^6$ |
| 0.400 | $1.20\times10^6$ to $9.60\times10^6$ |
| 0.500 | $1.00\times10^6$ to $8.00\times10^6$ |
| 0.600 | $0.80\times10^6$ to $6.40\times10^6$ |
| 0.651 | $0.70\times10^6$ to $5.58\times10^6$ |

In Table 2, the proportion of area, $\eta$, of the flat portion and the volume, V, of the recessed portion per $mm^2$ are in the range of from 0.215 to 0.651 and in the range of from $0.70\times10^6$ to $12.56\times10^6$. For applications such as an inner plate for automobiles where good moldability under severe conditions is required without detriment to the painting sharpness, when the volume, V, of the recessed portion per $mm^2$ is less than $0.70\times10^6$, since the amount of press molding lubricant for wetting the recessed portion is unsatisfactory, cracking frequently occurs on the surface of the steel strip after press molding. For this reason, the lower limit of the V value is $0.70\times10^6$ ($\mu m^3/mm^2$).

(2) When P=1.0 d to 2.0 d, $$\eta=0.215 \text{ to } 0.804 \tag{14}$$

When the volume per recessed portion in the present invention is expressed by the following equation:

$$u=(\pi d^2/4)\times h \tag{15}$$

if we assume that $P_1=P_2=P$ and h=16 to 40 μm, the volume of the recessed portion per $mm^2$ according to the present invention can be determined as follows.

$$V = u \times n = (\pi/4) \times (d/P)^2 \times h \times 10^6 = h \times (1-\eta) \times 10^6 = (16 \text{ to } 40) \times (1-\eta) \times 10^6 \ (\mu m^3/mm^2) \quad (16)$$

The relationship between the proportion of area, $\eta$, of the flat portion and the volume, V, of the recessed portion per $mm^2$ was determined according to the above-described equation (16), and the results are given in Table 3.

Numeral values within the parentheses in Table 3 are each determined according to the equation (16), and the lower limit of the volume, V, of the recessed portion per $mm^2$ in the present invention is $8.00 \times 10^6$ ($\mu m^3/mm^2$).

In Table 3, the proportion of area, $\eta$, of the flat portion is in the range of from 0.215 to 0.840, and the volume, v, of the recessed portion per $mm^2$ is in the range of from 8.00 to $39.25 \times 10^6$. For applications such as an inner plate for automobiles where good moldability under severe conditions is required without detriment to the painting sharpness, when the volume, V, of the recessed portion per $mm^2$ is less than $8.00 \times 10^6$, since the amount of press molding lubricant for wetting the recessed portion is unsatisfactory, cracking frequently occurs on the surface of the steel strip after press molding. For this reason, the lower limit of the V value is $8.00 \times 10^6$ ($\mu m^3/mm^2$).

TABLE 3

| Percentage area of flat portion, $\eta$ | Volume of recessed portion per $mm^2$, V |
|---|---|
| 0.215 | $12.56 \times 10^6$ to $39.25 \times 10^6$ |
| 0.300 | $11.20 \times 10^6$ to $35.00 \times 10^6$ |
| 0.400 | $9.60 \times 10^6$ to $30.00 \times 10^6$ |
| 0.500 | $8.00 \times 10^6$ to $25.00 \times 10^6$ |
| 0.600 | $(6.40) \times 10^6$ to $20.00 \times 10^6$ |
| 0.700 | $(4.80) \times 10^6$ to $15.00 \times 10^6$ |
| 0.800 | $(3.20) \times 10^6$ to $10.00 \times 10^6$ |

(3) When P=1.5 d to 4.0 d, $$\eta = 0.651 \text{ to } 0.951 \quad (17)$$

When the volume per recessed portion in the present invention is expressed by the following equation:

$$u = (\pi d^2/4) \times h \quad (18)$$

if we assume that $P_1 = P_2 = P$ and h=16 to 40 $\mu$m, the volume of the recessed portion per $mm^2$ according to the present invention can be determined as follows.

$$V = u \times n = (\pi/4) \times (d/P)^2 \times h \times 10^6 = h \times (1-\eta) \times 10^6 = (16 \text{ to } 40) \times (1-\eta) \times 10^6 \ (\mu m^3/mm^2) \quad (19)$$

The relationship between the proportion of area, $\eta$of the flat portion and the volume, V, of the recessed portion per $mm^2$ was determined according to the above-described equation (19), and the results are given in Table 4. (The upper limit of the volume, V, of the recessed portion is $8.00 \times 10^6$.)

TABLE 4

| Percentage area of flat portion, $\eta$ | Volume of recessed portion per $mm^2$, V |
|---|---|
| 0.600 | $6.40 \times 10^6$ to $8.00 \times 10^6$ |
| 0.650 | $5.60 \times 10^6$ to $8.00 \times 10^6$ |
| 0.700 | $4.80 \times 10^6$ to $8.00 \times 10^6$ |
| 0.750 | $4.00 \times 10^6$ to $8.00 \times 10^6$ |
| 0.800 | $3.20 \times 10^6$ to $8.00 \times 10^6$ |
| 0.850 | $2.40 \times 10^6$ to $6.00 \times 10^6$ |
| 0.900 | $1.60 \times 10^6$ to $4.00 \times 10^6$ |
| 0.950 | $(0.80) \times 10^6$ to $2.00 \times 10^6$ |

(4) When P=2.5 d to 4.0 d, $$\eta = 0.874 \text{ to } 0.951 \quad (20)$$

When the volume per recessed portion in the present invention is expressed by the following equation:

$$u = (\pi d^2/4) \times h \quad (21)$$

if we assume that $P_1 = P_{2=P \text{ and } h=}$2 to 16 $\mu$m, $$V = u \times n = (\pi/4) \times (d/P)^2 \times h \times 10^6 = h \times (1-\eta) \times 10^6 = (2 \text{ to } 16) \times (1-\eta) \times 10^6 \ (\mu m^3/mm^2) \quad (22)$$

The relationship between the proportion of area, $\eta$, of the flat portion and the volume, V, of the recessed portion per $mm^2$ was determined according to the above-described equation (22), and the results are given in Table 5.

TABLE 5

| Percentage area of flat portion, $\eta$ | Volume of recessed portion per $mm^2$, V |
|---|---|
| 0.874 | $0.25 \times 10^6$ to $2.02 \times 10^6$ |
| 0.900 | $0.20 \times 10^6$ to $1.60 \times 10^6$ |
| 0.925 | $0.15 \times 10^6$ to $1.20 \times 10^6$ |
| 0.951 | $0.10 \times 10^6$ to $0.78 \times 10^6$ |

In Table 5, the proportion of area, $\eta$, of the flat portion is in the range of from 0.874 to 0.951, and the volume, V, of the recessed portion per $mm^2$ is in the range of from $0.10 \times 10^6$ to $2.0 \times 10^6$ ($\mu m^3/mm^2$).

The production of the rolling dull roll for producing the steel strip of the present invention will now be described in more detail.

FIG. 7 is a diagram explaining the method for producing a roll according to the present invention. As shown in FIG. 7 (*a*), the surface of the roll 16 is previously plated with Cr to form a Cr plating 17. The plating is effected under a current density of 20 to 50 $A/dm^2$, a making current of 1000 to 2000 A so as to form a Cr plating having a thickness of 2 to 10 $\mu$m. Thereafter, as shown in FIG. 7 (*b*), the surface of the roll is coated with a resin 18 so that the coating thickness is in the range of from about 5 to 50 $\mu$m.

An alkaline resin, a resin for coat sealing, etc. are preferred as the coating resin because they have an alkali resistance, a chromic acid resistance, an insulating property, etc., and examples thereof include an acrylic resin, a methacrylic resin, a methacrylic ester, a polyolefin resin, an epoxy resin, a vinyl chloride resin and a polyamide resin. These resins are coated on the surface of a roll so as to form a coating having a thickness of 5 to 50 μm. The coating is effected by homogeneously depositing the resin on the surface of the roll by irrotational roll drawing, electrodeposition coating, rotational roll coating, spraying, curtain coating, powder coating, winding of a filmy resin, etc. and drying the resultant coating.

As shown in FIG. 7 (*c*), the resin coated roll 16 is then subjected to machining by means of a high-density energy, for example, a laser beam 20 condensed by a condensing lens 19. Specifically, the surface of the resin coating 18 is irradiated with a laser beam 20 to melt and remove the portion exposed to the laser beam. At that time, two laser beams are applied in such a manner that one laser beam is slightly delayed so as to provide a double laser beam application such that the first applied laser beam melts and removes the resin and the second applied laser beam completely volatilizes and removes impurities deposited in the recessed portion of the hole.

The diameter of the recessed portion 21 of the hole after the resin is melted and removed can be regulated by laser beam irradiation conditions, particularly a gap between the laser output condensing lens and the roll (a focusing lag).

The diameter of the recessed portion after the resin is melted and removed is also greatly influenced by the thickness of the resin coated on the surface of the roll. For example, when laser irradiation conditions are constant, if the resin coating thickness is large, the diameter of the recessed portion after the resin is melted and removed becomes small, while if the resin coating thickness is small, the diameter of the recessed portion becomes large. For this reason, in the present invention, the resin coating thickness in the vicinity of a working head is measured by means of a coating thickness meter (for example, an electromagnetic coating thickness meter) during laser beam irradiation so that the diameter of the recessed portion after the resin has been melted and removed is in a predetermined range. A laser beam machining head is moved while rolling the resin coated roll so as to correct laser beam irradiation conditions depending upon the resin coating thickness, and a laser beam is then applied at a machining frequency and the number of revolutions of the roll is based on predetermined pitch intervals, P.

After the laser beam machining, as shown in FIG. 7 (*d*), the roll of the present invention is plated with chromium in a chromium plating solution. Specifically, the roll is electroplated in a chromium plating solution under a current density of 20 to 50 $A/dm^2$ and a making current of 1000 to 2000 A, which is a making current value capable of providing a diameter, D, of 50 to 200 μm in the recessed portion after dissolution and removal of the resin, that is, a making current value depending upon the effective area ratio of the chromium plated portion, etc., thereby enabling a chromium protrusion having a thickness of 1 to 20 μm to be deposited in the bore diameter formed by the above-described laser beam machining. In this case, since the resin is an insulating substance, plating is applied in the bore portion alone at a thickness substantially equal to or smaller than the resin thickness under set plating conditions without deposition of chromium on the surface of the resin. FIG. 7 (*d*) shows the state of the surface after chromium plating, and a chromium protrusion 22 having a curved surface formed by electroplating is deposited in the recessed portion of the bore 21 defined by the resin 18 and the chromium plated portion 17 on the surface of the roll.

The roll provided with the chromium protrusion 22 is then immersed in a solvent or brushed with a solvent to remove the resin on the surface of the roll.

Thus, as shown in FIG. 7 (*e*), a chromium protrusion 22 is exposed to the chromium plated portion on the surface of the roll from which the resin has been removed.

Thus, according to the present invention, a roll provided with a chromium protrusion formed in a continuous manner on the surface of the roll at predetermined intervals and having a homogeneous configuration within the roll can be produced through the above-described steps.

Figure 8:
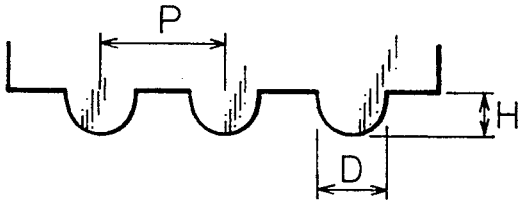
FIG. 8 is a schematic cross-sectional view of the rolling dull roll according to the present invention.

FIG. 8 is a schematic diagram showing a configuration of the cross-section of the roll according to the present invention. The surface of the roll is provided with a protrusion composed mainly of chromium and formed in a predetermined pattern by laser beam irradiation, and according to the present invention, such a homogeneous configuration is formed in the rolling direction or in the rolling direction and a direction perpendicular to the rolling direction.

Figure 9:
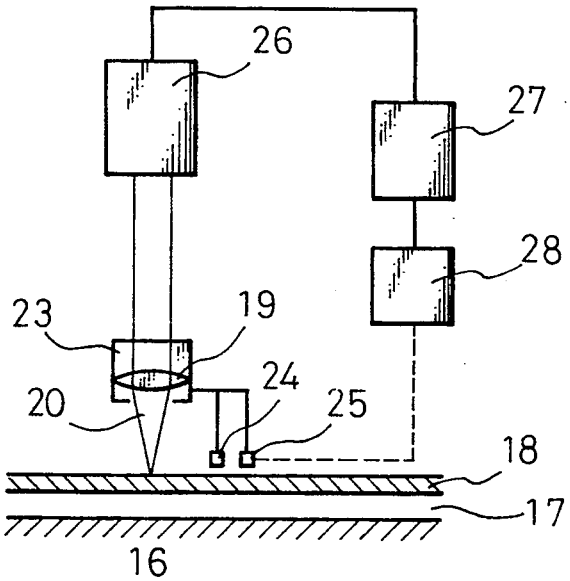
FIG. 9 is a diagram showing the construction of an apparatus for producing the rolling dull roll according to the present invention.

FIG. 9 is a diagram showing an apparatus for homogeneously forming the protrusion composed mainly of chromium on the surface of the roll according to the present invention. In the step of effecting for example, laser beam irradiation from the surface of the resin 18 coated on the Cr plating 17 on the surface of the roll to melt and remove the resin, a laser beam 20 is transmitted from a laser oscillator 26 through an optical system to a condensing lens 19. The condensing lens 19 is fixed within a machining head 23 movable in a direction perpendicular to the roll 16. Two sensors are provided in the vicinity of the machining head 23. One of the sensors is a gap sensor 24 and serves to measure the gap between the condensing lens and the roll during laser beam irradiation (position of focal point). The other sensor is a coating thickness meter 25 (for example, an electromagnetic meter) provided in the vicinity of the machining head 23. This sensor serves to measure the coating thickness of the resin coated on the surface of the roll in the vicinity of the machining head. The diameter of the recessed portion after the resin is melted and removed is greatly influenced by the thickness of the resin coated on the surface of the roll and the laser beam irradiation conditions (a laser beam output, a gap between the condensing lens and the roll (position of focal point)), etc.

The laser beam output can be maintained at a constant value after predetermined conditions are set. However, the diameter of the recessed portion after melting and removal by means of laser beam irradiation varies significantly and causes a variation in roughness within the roll if no measure is taken when the gap between the condensing lens and the roll varies during laser beam irradiation owing to the presence of crowns etc. on the surface of the roll to be machined, which causes the focal point to deviate when the coating thickness of the resin coated on the surface of the roll partially varies within the roll, or when other unfavorable phenomenon occurs. When the gap (position of focal point) between the condensing lens and the roll deviates (defocuses) on the + side or − side from the focal distance and when the thickness of the resin coated on the surface of the roll is excessive, the diameter of the recessed portion after the resin is melted and removed becomes small, and the diameter of the protrusion provided on the surface of the roll and composed mainly of chromium also becomes small.

On the other hand, when the gap (position of focal point) between the condensing lens and the roll is ±0 μm from the focal distance (that is, just focused) and when the thickness of the resin coated on the surface of the roll is small, the diameter of the recessed portion after the resin is melted and removed becomes large and the diameter of the protrusion provided on the surface of the roll and composed mainly of chromium also becomes large.

Factors having an influence on the diameter of the recessed portion after melting and removal of the resin, and in turn, on the variation of the diameter of the protrusion composed mainly of chromium and provided on the surface of the roll include: (1) laser output conditions, (2) gap (position of focal point) between the condensing lens and the roll and (3) thickness of the resin coated on the surface of the roll. In the prior art, among the above-described conditions, conditions (1) and (2) alone are taken into consideration when effecting laser beam irradiation, and variations in the coating thickness of the resin is not taken into consideration. In the present invention, the influence of variations in the coating thickness of the resin is corrected to attain a homogeneous roughness within the roll. For attaining this purpose, as shown in FIG. 9, a coating thickness meter 25 (for example, an electromagnetic coating thickness meter) is provided in the vicinity of a laser machining head 23, the thickness of the resin coated on the surface of the roll is measured during laser beam irradiation, and the results are used to correct the laser beam output for machining by means of a computing element 28. The data are then sent to a controller 27 of a laser beam machining apparatus to regulate output conditions of the laser oscillator 26. The laser beam 20, which has been corrected according to resin coating conditions, is sent from the laser oscillator 26 to an optical system, led to a condensing lens 19, which condenses the light, and is then continuously applied at a predetermined pitch on the surface of the resin coated on the surface of the roll. At that time, in the present invention, with respect to the diameter of the recessed portion after the resin is melted and removed, that is, with respect to the diameter of the protrusion portion composed mainly of chromium and provided on the surface of the roll, since the influence of variations in the coating thickness distribution is corrected, it becomes possible to attain a homogeneous roughness within the roll.

EXAMPLES

The effect of the present invention will now be described in more detail with reference to the following Examples.

EXAMPLE 1

A cold-rolled steel strip having a thickness of 0.75 mm was subjected to temper rolling by means of the rolling dull roll according to the present invention to transfer a rough surface formed on the surface of the roll to the steel strip. The pattern of the configuration formed at that time is given in Table 5. In Table 5, the P value is in the range of from 1.0 6 to 1.5 d, and the h value is in the range of from 2 to 16 μm.

TABLE 5

| | | Configuration pattern | | | | | | Test of inner plate for automobile | |
|---|---|---|---|---|---|---|---|---|---|
| | | d | $p_1$ | $p_2$ | h | η | v | Press moldability | L.D.R. value |
| Steel strip of present invention | 1 | 300 | 1.0d | 1.0d | 2 | 0.215 | 1.57 | good | 2.80 |
| | 2 | 70 | 1.0d | 1.0d | 9 | 0.215 | 7.07 | good | 2.89 |
| | 3 | 100 | 1.0d | 1.0d | 15 | 0.215 | 11.78 | good | 2.98 |
| | 4 | 150 | 1.2d | 1.2d | 2 | 0.455 | 1.09 | good | 2.84 |
| | 5 | 200 | 1.2d | 1.2d | 9 | 0.455 | 4.91 | good | 2.89 |
| | 6 | 500 | 1.2d | 1.2d | 15 | 0.455 | 8.18 | good | 2.99 |
| | 7 | 400 | 1.4d | 1.4d | 2 | 0.599 | 0.80 | good | 2.78 |
| | 8 | 100 | 1.4d | 1.4d | 9 | 0.599 | 3.61 | good | 2.82 |
| | 9 | 200 | 1.4d | 1.4d | 15 | 0.599 | 6.02 | good | 2.97 |
| Comp. Ex. | 10 | 70 | 1.2d | 1.2d | 1 | 0.455 | 0.55 | frequent occurrence of cracking | 2.45 |
| | 11 | 100 | 2.0d | 2.0d | 2 | 0.804 | 0.39 | frequent occurrence of cracking | 2.40 |
| | 12 | 200 | 4.0d | 4.0d | 10 | 0.951 | 0.49 | frequent occurrence of cracking | 2.35 |

Steel strips having such a recessed portion that the diameter is d (μm), the center line distance between recessed portions is $P_1$ (μm), the center line distance between rows in the direction of rolling is $P_2$ (μm), the depth of the recessed portion is h (μm), the proportion of area of the flat portion is η and the volume per $mm^2$ of the surface of the steel strip is V ($\times 10^6$ $\mu m^3/mm^2$) were subjected to an evaluation concerning the useability as an inner plate for an automobile in terms of the presence or absence of cracking (press moldability) after working and the limitation draw ratio (L.D.R.). The L.D.R. value was determined by determining the maximum material plate diameter capable of effecting deep drawing by means of a mold having a punch diameter of 32 mm and determining the ratio of the maximum material strip plate diameter to the diameter of the punch. Nos. 1 to 9 represent the steel strip of the present invention and Nos. 10 to 12 represent Comparative Examples. In applications such as an inner plate for automobiles where good moldability under severe conditions is required without detriment to the painting sharpness, when the volume, V, of the recessed portion per $mm^2$ is less than $0.70\times 10^6$, since the amount of press molding lubricant for wetting the recessed portion becomes unsatisfactory, cracking frequently occurs on the surface of the steel strip after press molding. For this reason, the lower limit of the V value is $0.70\times 10^6$ ($\mu m^3/mm^2$).

Figure 1:
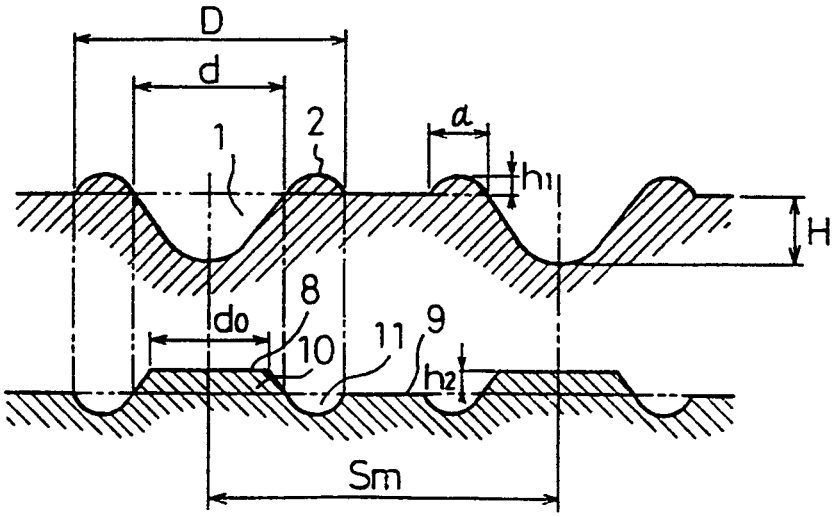
FIG. 1 PRIOR ART
FIG. 1 is a diagram showing a conventional roll for producing a steel strip and the surface of a steel strip.
Figure 2:
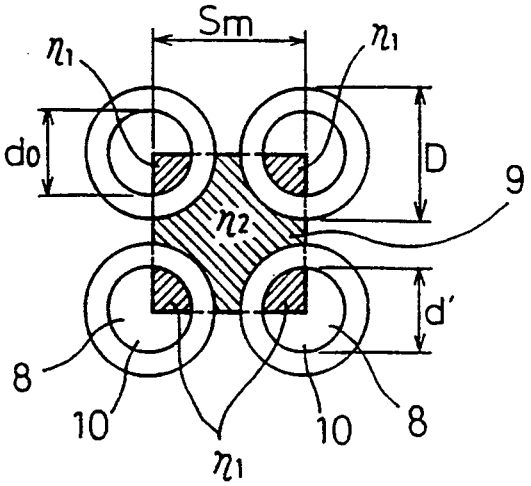
FIG. 2 PRIOR ART
FIG. 2 is a schematic plan view of the surface of a conventional steel strip.
Figure 3A:
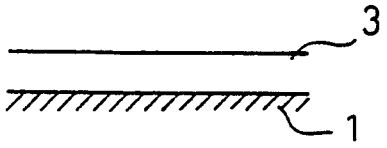
FIG. 3(a) PRIOR ART
FIGS. 3(*a*), 3(*b*), 3(*c*) and 3(*d*) are conceptual diagrams of an embodiment of a conventional method for producing a rolling dull roll that is used to produce a steel strip.
Figure 3B:
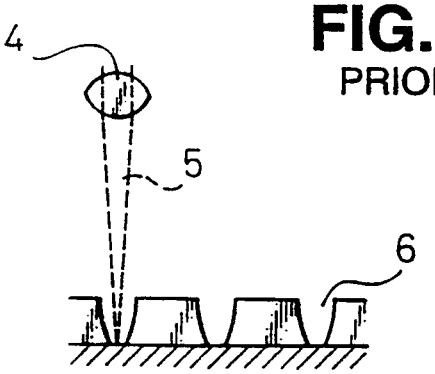
FIG. 3(b) PRIOR ART
Figure 3C:
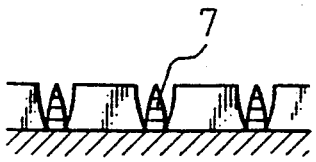
FIG. 3(c) PRIOR ART
Figure 3D:
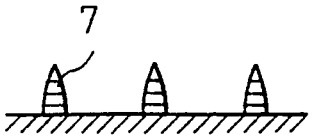
FIG. 3(d) PRIOR ART
Figure 4:
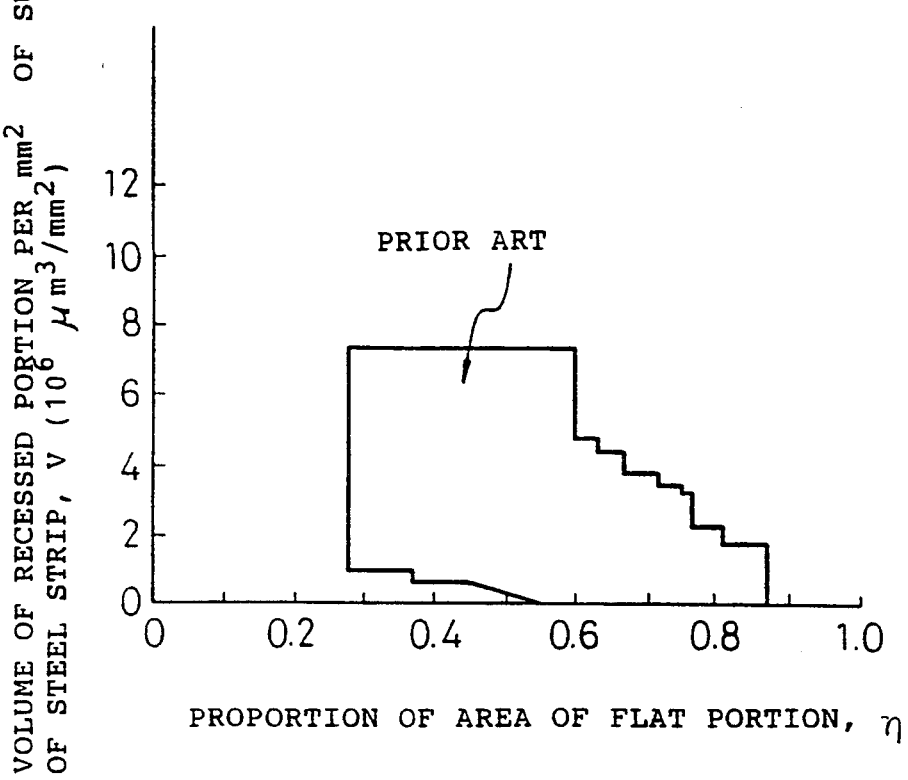
FIG. 4 PRIOR ART
FIG. 4 is a diagram showing the relationship between the volume, V ($\mu m^3/mm^2$), of the recessed portion per $mm^2$ of the surface of a conventional steel strip and the proportion of area, $\eta$, of the flat portion of the steel strip.

The conventional configuration pattern of a steel strip shown in FIG. 1 is summarized in Table 6. Steel strips having such a configuration pattern that the average diameter of the outer periphery of the root portion 11 on the surface of the steel strip is D, the average diameter of the crest face 8 of the crest portion 10 on the surface of the steel strip is $d_0$, the width of the flange 2 on the surface of the surface of the roll is $\alpha$, the average center distance between adjacent crest portions 10 on the surface of the steel strip is Sm (unit of all the above items being $\mu$m), the proportion of area of the flat portion is $\eta$ and the proportion of volume of the recessed portion is V ($\times 10^6$ $\mu m^3/mm^2$) were subjected to an evaluation concerning the useability as an inner plate for an automobile in terms of the presence or absence of cracking (press moldability) after working and the limitation draw ratio (L.D.R.).

TABLE 6

| | | Configuration pattern | | | | | | Test of inner plate for automobile | |
|---|---|---|---|---|---|---|---|---|---|
| | | D | $d_o$ | $\alpha$ | Sm | $\eta$ | v | Press moldability | L.D.R. value |
| Conventional steel strip | 13 | 160 | 100 | 30 | 160 | 0.521 | 5.67 | frequent occurence of cracking | 2.50 |
| | 14 | 160 | 100 | 30 | 200 | 0.694 | 3.61 | frequent occurrence of cracking | 2.48 |
| | 15 | 160 | 100 | 30 | 250 | 0.804 | 2.31 | frequent occurrence of cracking | 2.43 |
| | 16 | 160 | 100 | 30 | 300 | 0.864 | 1.60 | frequent occurence of cracking | 2.40 |
| | 17 | 210 | 150 | 30 | 210 | 0.615 | 4.53 | frequent occurrence of cracking | 2.47 |
| | 18 | 210 | 150 | 30 | 250 | 0.729 | 3.20 | frequent occurrence of cracking | 2.42 |
| | 19 | 210 | 150 | 30 | 300 | 0.812 | 2.22 | frequent occurrence of cracking | 2.38 |
| | 20 | 210 | 150 | 30 | 350 | 0.862 | 1.63 | frequent occurrence of cracking | 2.36 |

In table 6, $\eta$ and V were determined as follows.

$$\eta = 1-(4/\pi)\times(D^2-d_0^2)/Sm^2 \quad (23)$$

$$V=(\pi^2/16)\times\alpha^2\times(D+d_0)\times 10^4 \quad (24)$$

EXAMPLE 2

A cold-rolled steel strip having a thickness of 0.75 mm was subjected to temper rolling by means of the rolling dull roll according to the present invention so as to transfer a rough surface formed on the surface of the roll to the steel strip. The pattern of the configuration formed at that time is given in Table 7. In Table 7, the P value is in the range of from 1.0 d to 2.0 d, and the h value is in the range of from 16 to 40 $\mu$m. As is apparent from the results of the inner plate test for an automobile shown in Table 7, the steel strips of the present invention are superior to the comparative steel strips in terms of both press moldability and L.D.R. value, and the results exhibited a significant improvement over the results for the conventional steel strips given in Table 6.

In applications such as an inner plate for automobiles where good moldability under severe conditions is required without detriment to the painting sharpness, when the volume, V, of the recessed portion per $mm^2$ is less than $8.00\times 10^6$, since the amount of press molding lubricant for wetting the recessed portion becomes unsatisfactory, cracking frequently occurs on the surface of the steel strip after press molding. For this reason, the lower limit of the V value is $8.00\times 10^6$ ($\mu m^3/mm^2$).

TABLE 7

| | | Configuration pattern | | | | | | Test of inner plate for automobile | |
|---|---|---|---|---|---|---|---|---|---|
| | | d | $p_1$ | $p_2$ | h | $\eta$ | v | Press moldability | L.D.R. value |
| Steel strip of present invention | 21 | 300 | 1.1d | 1.1d | 16 | 0.351 | 10.38 | good | 2.86 |
| | 22 | 70 | 1.1d | 1.1d | 20 | 0.351 | 12.98 | good | 2.99 |
| | 23 | 100 | 1.4d | 1.4d | 20 | 0.599 | 8.02 | good | 2.88 |
| | 24 | 150 | 1.1d | 1.1d | 30 | 0.351 | 19.47 | good | 3.04 |
| | 25 | 200 | 1.4d | 1.4d | 30 | 0.599 | 12.03 | good | 2.98 |
| | 26 | 500 | 1.7d | 1.7d | 30 | 0.728 | 8.16 | good | 2.85 |
| | 27 | 400 | 1.1d | 1.1d | 40 | 0.351 | 25.96 | good | 3.23 |
| | 28 | 100 | 1.4d | 1.4d | 40 | 0.599 | 16.04 | good | 3.08 |
| | 29 | 200 | 1.9d | 1.9d | 40 | 0.782 | 8.72 | good | 2.83 |
| Comp. Ex. | 30 | 70 | 1.1d | 1.1d | 12 | 0.351 | 7.79 | frequent occurrence of cracking | 2.50 |

TABLE 7-continued

| | Configuration pattern | | | | | | Test of inner plate for automobile | |
|---|---|---|---|---|---|---|---|---|
| | d | $p_1$ | $p_2$ | h | $\eta$ | v | Press moldability | L.D.R. value |
| 31 | 100 | 1.9d | 1.9d | 20 | 0.782 | 4.36 | frequent occurrecne of cracking | 2.48 |
| 32 | 200 | 2.5d | 2.5d | 30 | 0.874 | 3.78 | frequent occurrence of cracking | 2.45 |

Figure 10:
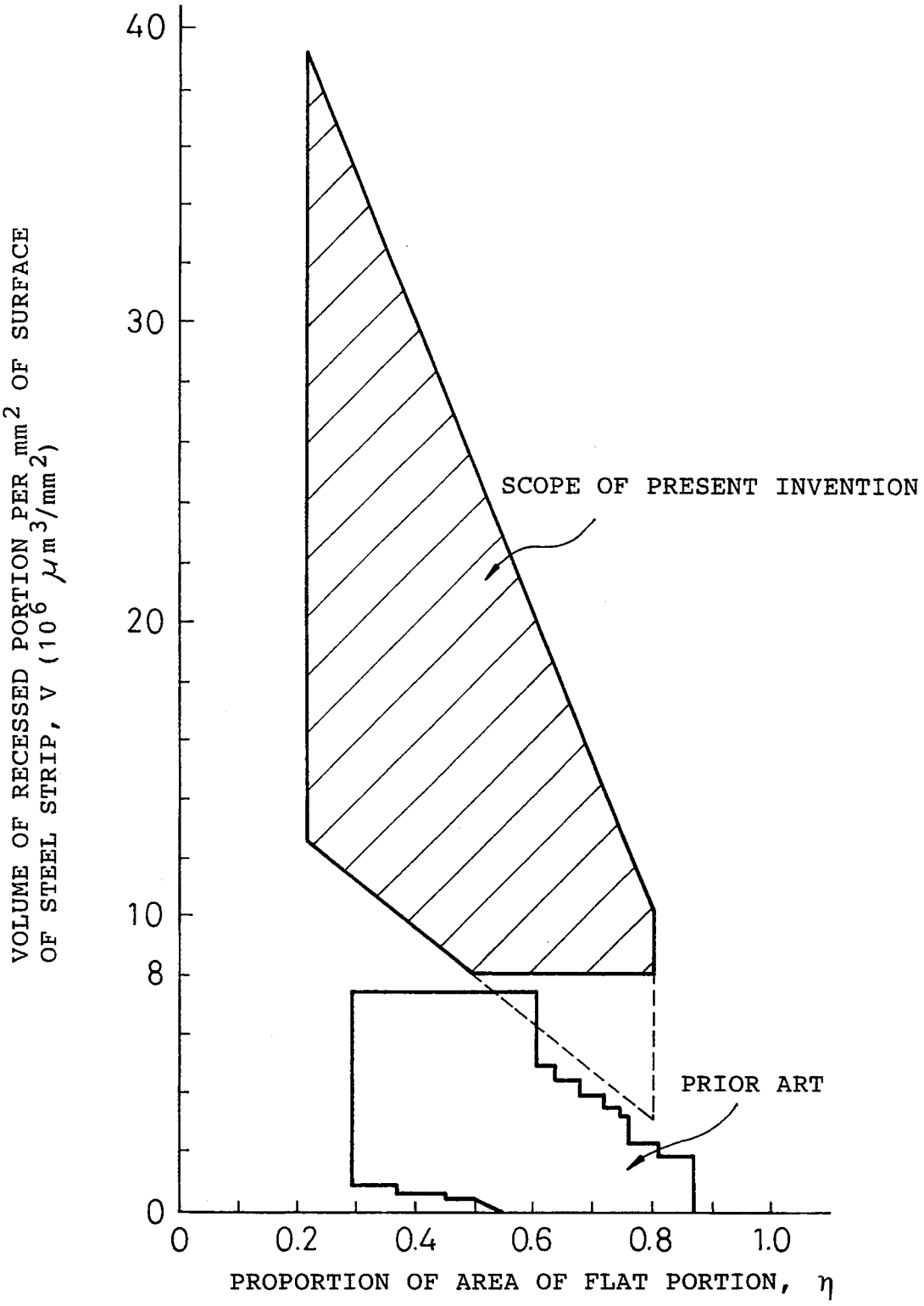
FIG. 10 is a diagram showing the relationship between the proportion of area, $\eta$, of the flat portion and the volume, V ($\times10^6$ $\mu m^3/mm^2$), per $mm^2$ of the surface of the steel strip according to the present invention in comparison with a conventional steel strip.

FIG. 10 is a diagram showing the relationship between the proportion of area, $\eta$, of the flat portion and the volume, V ($\times 10^6$ $\mu m^3/mm^2$), per $mm^2$ of the surface of the steel strip according to the present invention specified in Table 3 in comparison with a conventional steel strip specified in Table 1. In all the conventional steel strips, the volume, V, of the recessed portion is less than $8.00\times 10^6$, whereas in all the steel strips of the present invention, the volume, V, of the recessed portion is $8.00\times 10^6$ or more.

EXAMPLE 3

A cold-rolled steel strip having a thickness of 0.75 mm was subjected to temper rolling by means of the rolling dull roll according to the present invention so as to transfer a rough surface formed on the surface of the roll to the steel strip. The pattern of the configuration formed at that time is given in Table 8. In Table 8, the P value is in the range of from 1.5 d to 4.0 d, and the h value is in the range of from 16 to 40 $\mu m$. As is apparent from the results of the test of an outer plate for an automobile shown in Table 8, the steel strips of the present invention are superior to the comparative steel strips in both press moldability and sharpness evaluation (in terms of NSIC value), and the results exhibited a significant improvement over the results for the conventional steel strips given in Table 10. In order to evaluate the sharpness, with respect to each configuration pattern of the steel strips, a chemical conversion treatment was effected with a phosphate, and the treated steel strips were then subjected to a two-or three-coat application, that is, primer coating of a cationic ED paint to form a coating having a thickness of 18 to 20 $\mu m$ and intermediate coating to form a coating having a thickness of 30 to 35 $\mu m$ and/or top coating to form a coating having a thickness of 30 to 35 $\mu m$. Thereafter, the sharpness of the surface of the coating was evaluated by measuring the NSIC value by means of a sharpness meter.

A volume, V, of the recessed portion per $mm^2$ of $8.00\times 10^6$ satisfies the painting sharpness requirement without detriment to the press moldability required of an outer plate for an automobile and other applications. Although it may exceed the above value, since the proportion of area, $\eta$, of the flat portion is reduced, the above-described value was set as the upper limit. On the other hand, when the volume, V, of the recessed portion per $mm^2$ is less than $8.00\times 10^6$, the press moldability required of an outer plate for an automobile deteriorates. Further, in this case, since the amount of press molding lubricant for wetting the recessed portion becomes unsatisfactory, cracking frequently occurs on the surface of the steel strip after press molding. For this reason, the lower limit of the V value is $1.00\times 10^6$ ($\mu m^3/mm^2$).

Figure 11:
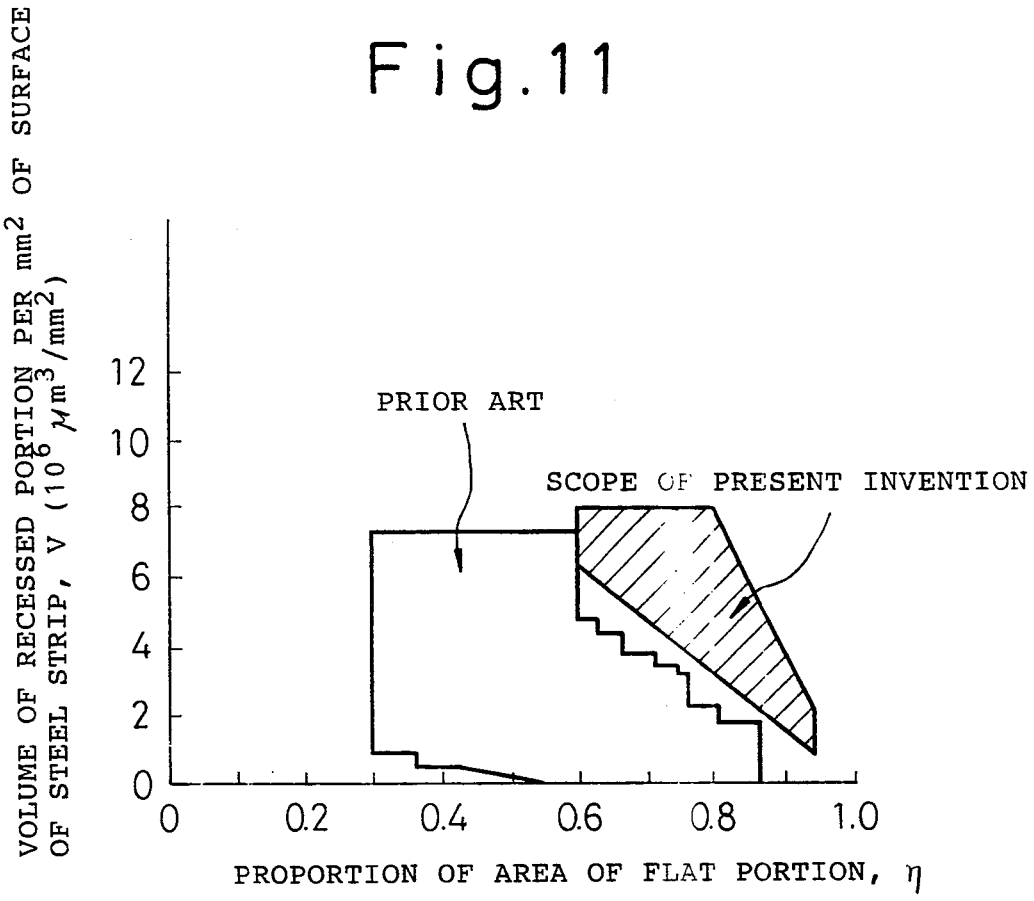
FIG. 11 is another diagram showing the relationship between the proportion of area, $\eta$, of the flat portion and the volume, V ($\times10^6$ $\mu m^3/mm^2$), per $mm^2$ of the surface of the steel strip according to the present invention in comparison with a conventional steel strip.

FIG. 11 is a diagram showing the relationship between the proportion of area, $\eta$, of the flat portion and the volume, V ($\times 10^6$ $\mu m^3/mm^2$), per $mm^2$ of the surface of the steel strip according to the present invention in comparison with a conventional steel strip. It is apparent that the proportion of area, $\eta$, of the flat portion in the steel strip of the present invention is significantly improved over that of the conventional steel strip.

TABLE 8

| | | Configuration pattern | | | | | | Test of outer plate for automobile | |
|---|---|---|---|---|---|---|---|---|---|
| | | d | $p_1$ | $p_2$ | h | $\eta$ | v | Press moldability | NSIC value |
| Steel strip of present invention | 33 | 300 | 1.5d | 1.5d | 16 | 0.651 | 5.58 | good | 96 |
| | 34 | 70 | 1.5d | 1.5d | 20 | 0.651 | 6.98 | good | 96 |
| | 35 | 100 | 2.0d | 2.0d | 20 | 0.804 | 3.92 | good | 97 |
| | 36 | 150 | 2.0d | 2.0d | 30 | 0.804 | 5.88 | good | 96 |
| | 37 | 200 | 2.0d | 2.0d | 40 | 0.804 | 7.84 | good | 97 |
| | 38 | 500 | 3.0d | 3.0d | 20 | 0.913 | 1.74 | good | 98 |
| | 39 | 400 | 3.0d | 3.0d | 30 | 0.913 | 2.61 | good | 98 |
| | 40 | 100 | 3.0d | 3.0d | 40 | 0.913 | 3.48 | good | 98 |
| | 41 | 200 | 4.0d | 4.0d | 40 | 0.951 | 1.96 | good | 99 |
| Comp. Ex. | 42 | 100 | 1.0d | 1.0d | 20 | 0.215 | 15.70 | good | 65 |
| | 43 | 100 | 2.0d | 2.0d | 5 | 0.804 | 0.98 | frequent occurrence of cracking | 80 |
| | 44 | 100 | 4.0d | 4.0d | 16 | 0.951 | 0.79 | frequent occurrence of cracking | 85 |

EXAMPLE 4

A cold-rolled steel strip having a thickness of 0.75 mm was subjected to temper rolling by means of the rolling dull roll according to the present invention to transfer a rough surface formed on the surface of the roll to the steel strip. The pattern of the configuration formed at that time is given in Table 9. In Table 9, the P value is in the range of from 2.5 d to 4.0 d, and the h value is in the range of from 2 to 16 $\mu m$. The conventional configuration pattern of the steel strip is given in Table 10.

As is apparent from the results of the test of an outer plate for an automobile given in Table 9, the steel. strips of the present invention are superior to the comparative steel strips in both press moldability and sharpness evaluation (in terms of NSIC value), and the results exhibited a significant improvement over the results for the conventional steel strips given in Table 10.

A volume, V, of the recessed portion per $mm^2$ of $2.00\times10^6$ satisfies the painting sharpness requirement without detriment to the press moldability required of an outer plate for an automobile and other applications. It may exceed the above value. In this case, however, since the proportion of area, $\eta$, of the flat portion is reduced, the above-described value was set as the upper limit. On the other hand, when the volume, V, of the recessed portion per $mm^2$ is less than $2.00\times10^6$, the press moldability required of an outer plate for an automobile deteriorates, and since the amount of press molding lubricant for wetting the recessed portion becomes unsatisfactory, cracking frequently occurs on the surface of the steel strip after press molding. For this reason, the lower limit of the V value is $0.1\times10^6$ ($\mu m^3/mm^2$).

Figure 12:
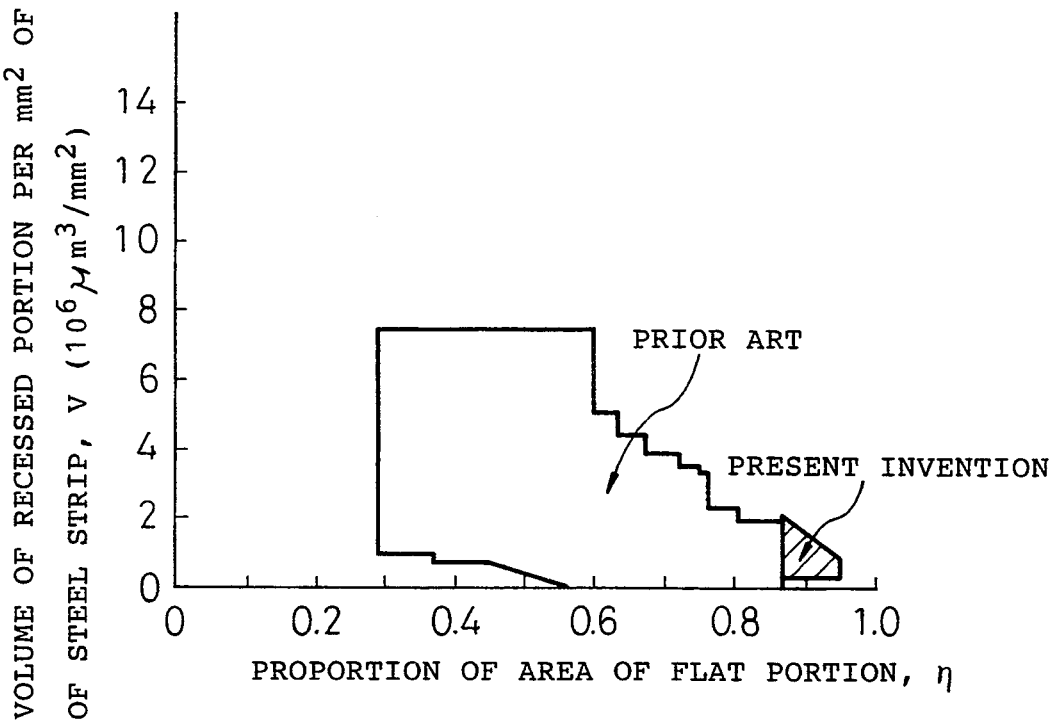
FIG. 12; is another diagram showing the relationship between the proportion of area, $\eta$, of the flat portion and the volume V ($\times10^6$ $\mu m^3/mm^2$), per $mm^2$ of the surface of the steel strip according to the present invention in comparison with a conventional steel strip.

FIG. 12 is another diagram showing the relationship between the proportion of area, $\eta$, of the flat portion and the volume, V ($\times10^6$ $\mu m^3/mm^2$), per $mm^2$ of the surface of the steel strip according to the present invention in comparison with a conventional steel strip.

The conventional configuration pattern of a steel strip shown in FIG. 1 is summarized in Table 10. Steel strips having such a configuration pattern that the average diameter of the outer periphery of the root portion 11 on the surface of the steel strip is D, the average diameter of the crest face 8 of the crest portion 10 on the surface of the steel strip is $d_0$, the width of the flange 2 on the surface of the surface of the roll is $\alpha$, the average center distance between adjacent crest portions 10 on the surface of the steel strip is Sm (unit of all the above items being $\mu m$), the proportion of area of the flat portion is $\eta$ and the proportion of volume of the recessed portion is V ($\times10^6$ $\mu m^3/mm^2$) were subjected to an evaluation concerning the useability as an outer plate for an automobile in terms of the presence or absence of cracking (press moldability) after working and sharpness (in terms of NSIC value).

In the conventional steel strip shown in FIG. 12, it is considered that since there exists a height ($h_2$) from the intermediate flat portion 9 of the flat crest face 8 in the crest portion 10 on the surface of the steel strip, the flat portion of the steel strip has a coated surface level difference, which deteriorates the gloss and promotes the occurrence of distortion of the transferred image, thereby reducing the painting sharpness, which renders the NSIC value inferior no that in the case of the present invention.

TABLE 9

| | | Configuration pattern | | | | | | Test of outer plate for automobile | |
|---|---|---|---|---|---|---|---|---|---|
| | | d | $p_1$ | $p_2$ | h | $\eta$ | v | Press moldability | NSIC value |
| Steel strip of present invention | 45 | 300 | 2.6d | 2.6d | 2 | 0.884 | 0.23 | good | 96 |
| | 46 | 70 | 2.6d | 2.6d | 9 | 0.884 | 1.04 | good | 96 |
| | 47 | 100 | 2.6d | 2.6d | 15 | 0.884 | 1.74 | good | 97 |
| | 48 | 150 | 3.3d | 3.3d | 2 | 0.928 | 0.14 | good | 97 |
| | 49 | 200 | 3.3d | 3.3d | 9 | 0.928 | 0.65 | good | 97 |
| | 50 | 500 | 3.3d | 3.3d | 15 | 0.928 | 1.08 | good | 98 |
| | 51 | 400 | 4.0d | 4.0d | 2 | 0.951 | 0.10 | good | 98 |
| | 52 | 100 | 4.0d | 4.0d | 9 | 0.951 | 0.44 | good | 98 |
| | 53 | 200 | 4.0d | 4.0d | 15 | 0.951 | 0.74 | good | 99 |
| Comp. Ex. | 54 | 100 | 1.0d | 1.0d | 5 | 0.215 | 3.93 | good | 63 |
| | 55 | 100 | 3.0d | 3.0d | 1 | 0.913 | 0.09 | frequent occurrence of cracking | 79 |
| | 56 | 100 | 5.0d | 5.0d | 2 | 0.969 | 0.06 | frequent occurrecne of cracking | 81 |

TABLE 10

| | | Configuration pattern | | | | | | Test of outer plate for automobile | |
|---|---|---|---|---|---|---|---|---|---|
| | | D | $d_0$ | $\alpha$ | Sm | $\eta$ | v | Press moldability | NSIC value |
| Conventional steel strip | 57 | 160 | 100 | 30 | 160 | 0.521 | 5.67 | frequent occurrence of cracking | 78 |
| | 58 | 160 | 100 | 30 | 200 | 0.694 | 3.61 | frequent occurrence of cracking | 79 |
| | 59 | 160 | 100 | 30 | 250 | 0.804 | 2.31 | frequent occurrence of cracking | 80 |
| | 60 | 160 | 100 | 30 | 300 | 0.864 | 1.60 | frequnt occurrence of cracking | 82 |
| | 61 | 210 | 150 | 30 | 210 | 0.615 | 4.53 | frequent occurrence of cracking | 78 |
| | 62 | 210 | 150 | 30 | 250 | 0.729 | 3.20 | frequent | 80 |

TABLE 10-continued

| | Configuration pattern | | | | | | Test of outer plate for automobile | |
|---|---|---|---|---|---|---|---|---|
| | D | $d_0$ | $\alpha$ | Sm | $\eta$ | v | Press moldability | NSIC value |
| 63 | 210 | 150 | 30 | 300 | 0.812 | 2.22 | occurrence of cracking frequent | 82 |
| 64 | 210 | 150 | 30 | 350 | 0.862 | 1.63 | occurrence of cracking frequent | 84 |
| | | | | | | | occurrence of cracking | |

In Table 10, the $\eta$ and V values satisfy respective requirements represented by the equations (23) and (24).

EXAMPLE 5

This example demonstrates the production of the rolling dull roll according to the present invention.

The surface of a work roll for temper rolling roll of a 5% Cr forged steel and having a diameter of 610 mmϕ was plated with Cr at a thickness of 2 to 10 μm, and an acrylic resin was coated thereon by roller coating to form a coating having a thickness of 5 to 50 μm, and the resultant coating was then dried. Then, a laser beam was applied to the surface of the coated roll at 8 to 20 W and passed through the surface of the coating to form a circular recessed portion. Specifically, a pulsed laser beam having constant irradiation conditions (that is, peak value and pulse width) were condensed by means of a condensing lens and then applied to the surface of the resin.

At that time, a variation in the coating thickness of the resin was measured by means of an electromagnetic coating thickness meter mounted in the vicinity of the laser beam machining head and used for a correction of the laser beam output. Specifically, the output conditions of the laser beam oscillator were regulated such that the diameter of the recessed portion after the resin was melted and removed becomes homogeneous. The laser beam machining head was moved in such a manner that the laser beam was continuously applied at a predetermined pitch to the surface of the resin coated on the surface of the roll, and the laser beam was applied and passed through the surface of the resin coated on the surface of the roll while moving the laser beam machining head, thereby forming a circular recessed portion on the surface of the roll. After completion of the laser beam machining, the roll was subjected to electrolytic degreasing under conditions of an alkaline solution temperature of 50° C. and a degreasing time of 120 sec and then plated with Cr in a chromic acid solution. Specifically, electroplating was effected in a chromic acid solution to adhere a chromium coating having a thickness of about 5 μm to the recessed portion formed on the surface of the roll. In this case, since the acrylic resin coated on the surface of the roll has an insulating property, the chromium plating was absent on the resin coated surface and applied in the recessed portion alone. After completion of the plating, the resin coated on the surface of the roll was removed by means of a brush. As a result, it was found that about 5 μm-thick chromium protrusions having an homogeneous configuration were formed on the surface of the roll.

The results of examination of the durability of chromium protrusion during rolling in the method for producing a rolling dull roll according to the present invention are given in Table 11 in comparison with the results in the case of the prior art.

In the prior art (5–8), the acrylic resin was directly coated on the surface of the roll substrate, laser beam irradiation was effected to remove the resin to form a recessed portion having an exposed roll substrate steel surface, and a chromium plating protrusion was formed on the exposed surface of the roll substrate steel. In this case, a locally concentrated stress applied to the chromium protrusion portion during rolling causes the chromium protrusion portion to be peeled in a rolling length of 10 km after the initiation of rolling. This phenomenon was significant in the prior art 8 where the height of the chromium protrusion was 20 μm or more, and the chromium protrusion was peeled immediately after initiation of the rolling.

Accordingly, in the present invention (1–4), the surface of the roll substrate steel was plated with chromium before coating with an acrylic resin for the purpose of improving adhesion between the surface of the roll and the chromium protrusion by using an identical element in the chromium plating of the recessed portion in the bore on the surface of the resin in the subsequent step.

Examination of the durability of chromium protrusion during rolling has revealed that, in the prior art 4 where the height of the chromium protrusion is 20 μm or more, a locally concentrated stress applied to the chromium protrusion portion during rolling causes the chromium protrusion portion to be peeled in a rolling length of 10 km after the initiation of rolling, whereas when the height of the chromium protrusion is 20 μm or less, no peeling occurs and rolling can be effected until a target roughness cannot be attained due to the progress of abrasion of the chromium protrusion.

The service life defined as a period of time before replacement of the roll becomes necessary due to abrasion of the chromium protrusion depends upon the initial height of the chromium protrusion, and when peeling or other phenomenon during rolling is taken into consideration, the height of the chromium protrusion is preferably about 1 to 20 μm.

TABLE 11

| | | Production conditions | | | | |
|---|---|---|---|---|---|---|
| | | Thickness of Cr plating on substrate | Thickness of resin coating | Diameter of protrusion | Height of protrusion | Durability (rolling length) |
| Present invention | 1 | 2–10 μm | 5–50 μm | 50–200 μm | 1–10 μm | ○ (100 km) |
| | 2 | 2–10 μm | 5–50 μm | 50–200 μm | 10–15 μm | ○ (200 km) |
| | 3 | 2–10 μm | 5–50 μm | 50–200 μm | 15–20 μm | ○ (300 km) |
| | 4 | 2–10 μm | 5–50 μm | 50–200 μm | 20 μm or more | Δ (peeled) |
| Conventional | 5 | — | 5–50 μm | 50–200 μm | 1–10 μm | Δ (100 km) |
| | 6 | — | 5–50 μm | 50–200 μm | 10–15 μm | Δ (200 km) |
| | 7 | — | 5–50 μm | 50–200 μm | 15–20 μm | Δ (300 km) |
| | 8 | — | 5–50 μm | 50–200 μm | 20 μm or more | X (peeled) |

Note)
○: The rolling length within the parentheses is the length of rolling necessary for the Cr protrusion to be abraded to such an extent that the service life expires.
Δ: The Cr protrusion peeled off within a rolling length of 10 km after the initiation of rolling.
X: The Cr protrusion peeled off immediately after the initiation of rolling.

INDUSTRIAL APPLICABILITY

As is apparent from the above-described examples, the rolling dull roll produced by the method of the present invention, which comprises previously effecting chromium plating before coating the resin, coating the surface of the plating with a resin, applying and passing a laser beam through the coating to form a bore having an exposed plating surface and subjecting the chromium plating surface in the recessed portion of the bore in the resin coating to another chromium plating treatment, can improve adhesion between the surface of the roll and the chromium protrusion by using an identical element in the chromium plating of the recessed portion in the bore in the resin coating, enables an outer plate for an automobile or other material produced by transferring the rough surface formed on the surface of the roll to a steel strip to be excellent in both sharpness after painting and press moldability and can provide a high-quality, high-grade, cold-rolled steel strip unattainable in the prior art, which renders the present invention very useful from the viewpoint of industry.

We claim:

1. A steel strip having excellent painting sharpness and press moldability, characterized by having a plurality of small recessed portions provided on the surface of the steel strip; said recessed portion having a configuration satisfying requirements of a diameters d, of 50 to 500 μm, a depth, h, of the recessed portion of 2 to 40 μm and a total volume of recessed portions per $mm^2$of the surface of the steel strip of $0.70\times10^6$ $\mu m^3$ or more, the center line distance, $P_1$, between recessed portions adjacent to each other in the direction of rolling being in the range of from 1.0 d to 2.0 d, the center line distance, $P_2$, between rows in the direction of rolling being in the range of from 1.0 d to 2.0 d.

2. A steel strip having excellent painting sharpness and press moldability according to claim 1, which satisfies the requirement of a depth, h, of the recessed portion of 2 to 16 μm and wherein the center line distance, $P_1$, between recessed portions adjacent to each other in the direction of rolling is in the range of from 1.0 d to 1.5 d and the center line distance, $P_2$, between rows in the direction of rolling is in the range of from 1.0 d to 1.5 d.

3. A steel strip having excellent painting sharpness and press moldability according to claim 1, wherein the depth, h, of the recessed portion is in the range of from 16 to 40 μm and the total volume of recessed portions per $mm^2$ of the surface of the steel strip is $8\times10^6$ $\mu m^3$ or more.

4. A steel strip having an excellent painting sharpness, characterized by having a plurality of small recessed portions provided on the surface of the steel strip; said recessed portion having a configuration satisfying requirements of a diameter, d, of 50 to 500 μm, a depth h, of the recessed portion of 2 to 40 μm and a total volume of recessed portions per $mm^2$ of the surface of the steel strip of $0.10\times10^6$ to $8\times10^6$ $\mu m^3$ or more and a proportion of area of the flat portion other than the recessed portion on the surface of the steel strip of 0.6 or more, the center line distance. $P_2$, between recessed portions adjacent to each other in the direction of rolling being in the range of from 1.5 d to 4.0 d, the center line distance, $P_2$, between rows in the direction of rolling being in the range of from 1.5 d to 4.0 d.

5. A steel strip having excellent painting sharpness and press moldability according to claim 4. wherein the depth, h, of the recessed portion is in the range of from 16 to 40 μm and the total volume of recessed portions per $mm^2$ of the surface of the steel strip is $1\times10^6$ to $8\times10_6$ $\mu m^3$.

6. A steel strip having excellent painting sharpness and press moldability according to claim 4, which satisfies the retirements of a depth, h, of the recessed portion of 2 to 16 μm, a total volume of recessed portions per $mm^2$ of the surface of the steel strip of $0.10\times10^6$ to $2\times10^6$ $\mu m^3$ and a proportion of area of the flat portion except for the recessed portion on the surface of the steel strip of 0.8 or more and wherein the center line distance, $P_1$, between recessed portions adjacent to each other in the direction of rolling is in the range of from 2.5 d to 4.0 d and the center line distance, $P_2$, between rows in the direction of rolling is in the range of from 2.5 d to 4.0 d.

7. A method for producing a rolling dull roll for producing a steel strip, comprising thinly coating Cr on the surface of a roll, thinly coating an insulating resin on the Cr coating, forming holes in the resin coating by a double high-density energy irradiation comprising a first irradiation for melting and removing the resin and a second irradiation for removing impurities deposited in a recessed portion of the holes, according to the thickness of the coated resin, immersing the irradiated roll in a chromic acid solution, subjecting the roll to another Cr plating treatment, and then removing the coated resin to provide a homogeneous protrusions composed mainly of Cr on the surface of the roll.

* * * * *

UNITED STATES PATENT AND TRADEMARK OFFICE

CERTIFICATE OF CORRECTION

PATENT NO. : 5,358,794

DATED : October 25, 1994

INVENTOR(S) : Takaharu KAWAMOTO, et al.

It is certified that error appears in the above-indentified patent and that said Letters Patent is hereby corrected as shown below:

Column 7, line 7, change "4.0," to --4.0d.--.

Column 7, line 17, change "wariness" to --waviness--.

Column 8, line 24, change "v," to --V,--.

Column 9, line 21, change "v," to --V,--.

Column 9, line 63, change "nof" to --n, of--.

Column 10, line 21, change "$P_1=P_2=P$ and $h=^2$" to --$P_1=P_2=P$ and h=2--.

Column 14, line 16, change "1.06" to --1.0d--.

Column 19, line 4, delete the period after "steel".

Column 24, line 42, change "$8X10_6$" to --$8X10^6$--.

Signed and Sealed this

Twenty-eight Day of March, 1995

*Attest:*

Bruce Lehman

BRUCE LEHMAN

*Attesting Officer*

*Commissioner of Patents and Trademarks*